US007360809B1

(12) United States Patent
Poston

(10) Patent No.: US 7,360,809 B1
(45) Date of Patent: Apr. 22, 2008

(54) KICK-IN RESISTANT DOOR REINFORCING ASSEMBLY

(75) Inventor: Kevin D. Poston, 111 E. 7th, Altoona, KS (US) 66710

(73) Assignees: Kevin D. Poston, Altoona, KS (US); Joel Associates, L.L.C., Wichita, KS (US)

( * ) Notice: Subject to any disclaimer, the term of this patent is extended or adjusted under 35 U.S.C. 154(b) by 102 days.

(21) Appl. No.: 10/934,294

(22) Filed: Sep. 3, 2004

(51) Int. Cl.
*E05B 15/02* (2006.01)
*E05B 17/00* (2006.01)

(52) U.S. Cl. ..... 292/340; 292/341.14; 292/346

(58) Field of Classification Search ..... 292/340, 292/341, 341.14, 346, DIG. 53, DIG. 54, 292/288, 289; 52/204.1, 210, 213, 215, 287.1, 52/288.1; 49/394, 460, 504
See application file for complete search history.

(56) References Cited

U.S. PATENT DOCUMENTS 1,399,897 A * 12/1921 Singer ..... 292/340
2,370,781 A * 3/1945 Cullum ..... 292/346
2,616,531 A * 11/1952 Young ..... 52/211
3,218,678 A * 11/1965 Russell ..... 49/489.1
3,328,064 A * 6/1967 Simon ..... 292/288
3,345,780 A * 10/1967 McGhee ..... 49/504
3,354,586 A * 11/1967 Den Besten ..... 49/504
3,826,526 A * 7/1974 Wepsala, Jr. ..... 292/346
3,963,269 A * 6/1976 Rosenberg ..... 292/346
3,967,845 A * 7/1976 Governale ..... 292/340
4,074,484 A * 2/1978 Queren ..... 52/214
4,174,862 A * 11/1979 Shane ..... 292/346
4,178,027 A * 12/1979 Charron ..... 292/346
4,295,299 A * 10/1981 Nelson ..... 49/504
4,345,787 A * 8/1982 Dabrowski ..... 292/346
4,390,867 A * 6/1983 Queren ..... 340/542
4,629,231 A * 12/1986 Bouchard ..... 292/346
4,684,160 A * 8/1987 Nelson ..... 292/340
4,690,445 A * 9/1987 Hartley ..... 292/341
4,717,185 A * 1/1988 Hartley ..... 292/340
4,720,129 A * 1/1988 Bouchard ..... 292/346
4,770,452 A * 9/1988 Petree, Jr. ..... 292/340
4,854,621 A * 8/1989 Baldwin ..... 292/340
4,858,384 A * 8/1989 Blankenship ..... 49/460
4,865,370 A * 9/1989 Francis ..... 292/340
4,955,648 A * 9/1990 Miller ..... 292/258
5,024,475 A * 6/1991 Francis ..... 292/340
5,127,690 A * 7/1992 Kim et al. ..... 292/340
5,241,790 A * 9/1993 Schimpf ..... 49/504
5,427,422 A * 6/1995 Madlener et al. ..... 292/264
5,566,509 A * 10/1996 Long ..... 49/462
5,581,948 A * 12/1996 Simonsen ..... 49/460
5,836,628 A * 11/1998 Beier ..... 292/346
6,082,049 A * 7/2000 Hudson ..... 49/460
6,178,700 B1 * 1/2001 Mayer, Jr. ..... 49/504
6,416,089 B1 * 7/2002 Williams, Jr. ..... 292/288
6,651,390 B2 * 11/2003 Camperelli ..... 49/504

(Continued)

*Primary Examiner*—Carlos Lugo
(74) *Attorney, Agent, or Firm*—Kenneth H. Jack; Davis & Jack, L.L.C.

(57) ABSTRACT

A kick-in resistant door reinforcing assembly consisting of a doorway hook having a laterally outwardly extending doorway engaging face; a jamb hook having a laterally inwardly extending jamb engaging face; and at least a first hook interconnecting flexible band spanning between the doorway and jamb hooks, the hook interconnecting flexible band being adapted for permitting alternate laterally inward and outward movements of the doorway and jamb hooks with respect to each other.

16 Claims, 3 Drawing Sheets

U.S. PATENT DOCUMENTS 6,729,664 B1 * 5/2004 Marsh et al. ..... 292/280
6,834,897 B1 * 12/2004 Walker ..... 292/340
6,880,717 B1 * 4/2005 O'Conor ..... 220/318
6,926,316 B2 * 8/2005 Patire et al. ..... 292/290
7,147,213 B1 * 12/2006 Amendola ..... 256/73
2003/0062731 A1 * 4/2003 Richmond et al. ..... 292/346
2005/0011132 A1 * 1/2005 Griffin, Jr. ..... 49/460

* cited by examiner

KICK-IN RESISTANT DOOR REINFORCING ASSEMBLY

FIELD OF THE INVENTION

This relates to home security apparatus and assemblies. More particularly, this invention relates to assemblies adapted for protecting residential or commercial building exterior doorways from forced entries resulting from applications of percussive forces to door exteriors.

BACKGROUND OF THE INVENTION

Residential and commercial buildings are commonly burglarized via unauthorized forced entry. Commonly, burglars who gain entry to a targeted residence or commercial building do so by applying a forceful flat-footed kick to the exterior of an entry door at a location near the door's hasp or bolt. Very commonly such kicking pressure causes the door's bolt to tear or break inwardly through the door's casing or vertical jamb which laterally borders the door and which includes an aperture for receiving the bolt. Upon such breakage of a door jamb, the door freely swings inwardly, allowing a burglar to access the interior of the building.

Various doorway reinforcing plates which operatively transfer such kicking forces from such door bolt or door jamb to the doorway's structurally solid door buck are known. However, such plates commonly interfere with proper door installation, undesirably disrupting a proper door jamb alignment.

The instant kick-in resistant doorway reinforcing invention solves or ameliorates the problems noted above by providing a door reinforcing plate assembly having an outer doorway or door buck engaging member, by providing an inner door jamb engaging member, and by further providing interconnecting means which are adapted for allowing free lateral movability of such engaging members with respect to each other during door hanging and door jamb aligning processes.

BRIEF SUMMARY OF THE INVENTION

A first structural component of the instant inventive kick-in resistant door reinforcing assembly comprises a doorway hook preferably having a laterally outwardly extending doorway or door buck engaging face. Preferably, the doorway hook comprises a steel "L" beam having a vertical length of approximately eight inches, having a web extending longitudinally approximately two inches, and having a foot extending laterally outwardly approximately three-quarter inches, the upper surface of such foot preferably comprising the doorway hook's laterally extending doorway engaging face. Where the doorway hook comprises, as preferred, an "L" beam, at least a first, and preferably a pair of fastener receiving slots or apertures extend through such beam's web, such slots or apertures preferably receiving laterally extending screws for mounting the "L" beam upon a doorway's door buck. Suitably, such slots or apertures may alternately extend through such "L" beam's foot. Also suitably, the doorway engaging element of the requisite doorway hook may comprise such screws themselves, omitting the preferred laterally extending foot element, and allowing surfaces of the screw to constitute the hook's doorway engaging face. Other commonly known hook configurations adapted for engaging a doorway or door buck may be suitably substituted for the preferred "L" beam doorway hook configuration.

A second structural component of the instant inventive kick-in resistant door reinforcing assembly comprises a jamb hook. Preferably, the jamb hook is configured substantially identically with the doorway hook with the exception that the jamb hook has jamb engaging face having a laterally inward extension which is necessarily opposite that of the doorway hook's doorway engaging face. Where the jamb hook is configured, as preferred, as an "L" beam, such hook's web preferably further has a bolt extension plate receiving aperture therethrough in addition to fastener receiving slots or apertures extending therethrough. Like the doorway engaging hook, screws which mount the jamb hook upon a door jamb may suitably, though less desirably, comprise the hooking element of the jamb hook, alternately omitting the preferred inwardly extending foot element.

A third structural component of the instant inventive kick-in resistant door reinforcing assembly comprises hook interconnecting means longitudinally spanning between the doorway and door jamb hooks, the hook interconnecting means being adapted for permitting alternate laterally inward and laterally outward movements of the doorway and door jamb hooks with respect to each other. Preferably, the hook interconnecting means comprises at least a first, and preferably a plurality of flexible steel bands which are welded in place. Suitably, the hook interconnecting means may alternately comprise straps, cables, cords, chains, or hinged plates.

During a process of installing a door and door casing assembly within a framed doorway, the casing's vertical door jamb members are typically vertically aligned within the doorway by wedge shimming. Such wedge shimming alignment process commonly causes slight lateral movements of the vertical door jambs with respect to the doorway's bordering door buck members. The hook interconnecting means element of the inventive assembly advantageously facilitates matching lateral movements of the doorway hook and/or jamb hook, and beneficially prevents the hooking elements from interfering with the door installation process.

In many instances, the throw or lateral travel of a door's bolt is not sufficient to extend the bolt beyond the lateral outer surface of the door's jamb. In such circumstances, and assuming that the inventive assembly includes the preferred apertured door jamb engaging "L" beam, such bolt's extension will fail to enter such aperture. In such circumstances, kicking forces applied to the door, and sequentially to the bolt, will undesirably fail to be directly transferred to the "L" beam. In order to directly mechanically transfer such kicking forces from the bolt to the preferred "L" beams, a bolt extension plate is provided, such plate preferably being fixedly welded to or formed wholly with a bolt receiving strike plate which is attached to the door jamb. The preferred bolt extension plate receiving aperture within the web of the jamb engaging "L" beam is necessarily positioned for laterally receiving such bolt extension plate. Suitably, though less desirably, the bolt extension plate's proximal end may alternately be fixedly attached to or formed wholly with the jamb engaging "L" beam, such plate's distal end oppositely extending laterally inwardly into the door jamb's bolt receiving aperture.

In operation of the preferred embodiment of the instant invention, as described above, an exterior kicking force applied to the protected door tends to drive the door's bolt against the bolt extension plate, sequentially driving such plate against an inner edge surface of the jamb engaging "L" beam's extension plate receiving aperture. Such kicking force may also simultaneously directly drive the door jamb against such "L" beam's foot. Substantially simultaneously, such kicking force is transferred to the doorway's structurally solid door buck via the flexible bands and the doorway or door buck engaging "L" beam.

Accordingly, an object of the instant invention is the provision of a kick-in resistant door reinforcing assembly which effectively transfers kick forces from a door to a doorway's structurally solid door buck and which incorporates paired door buck and door jamb engaging members incorporating interconnecting means adapted for allowing lateral travel of such members in accordance with lateral traveling motions of a door jamb with respect to a door buck during a door installation process.

Other and further objects, benefits, and advantages of the present invention have been described above and will become known to those skilled in the art upon review of the Detailed Description which follows, and upon review of the appended drawings.

DETAILED DESCRIPTION OF A PREFERRED EMBODIMENT

Figure 1:
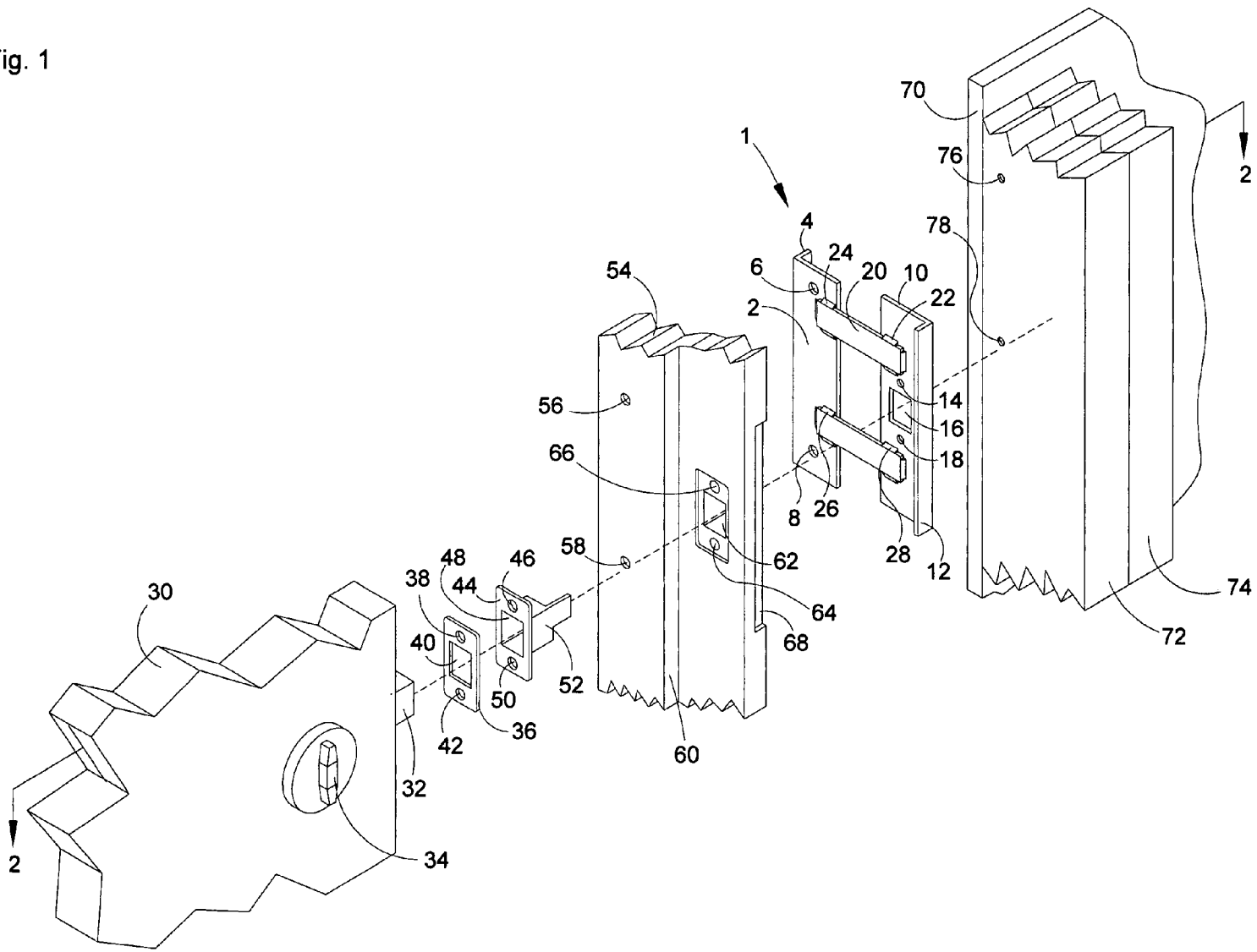
FIG. 1 is an isometric and exploded view of a preferred embodiment of the instant inventive kick-in resistant door reinforcing assembly.

Referring now to the drawings, and in particular to FIG. 1, a preferred embodiment of the instant inventive kick-in resistant door reinforcing assembly is referred to generally by Reference Arrow 1. The assembly 1 preferably comprises a first doorway or door buck engaging "L" beam which preferably comprises a web 2 which is formed wholly with a laterally outwardly extending foot or hook 4, the web portion 2 preferably having upper and lower screw receiving apertures 6 and 8. Such hooking portion 4 preferably lockingly engages a door buck 72 and 74, preferably via the outer surface of a building's exterior sheathing 70. Suitably, the foot/hook 4 may be mortised into the outer surface of sheathing 70 or, for longitudinal fitting purposes, may alternately extend into a vertical slot (not depicted) within sheathing 70 or within door buck 72. Suitably, though less desirably, the hook or foot portion 4 may be omitted and the requisite doorway engaging member may alternately exclusively comprise, referring further to FIG. 2, screws 86 which extend laterally outwardly through apertures 6 and 8 for threaded engagement within apertures 76 and 78, such screws dually mounting the web or plate 2 upon door buck 72 and, upon application of a longitudinal force, hookingly engaging the door buck.

Figure 2:
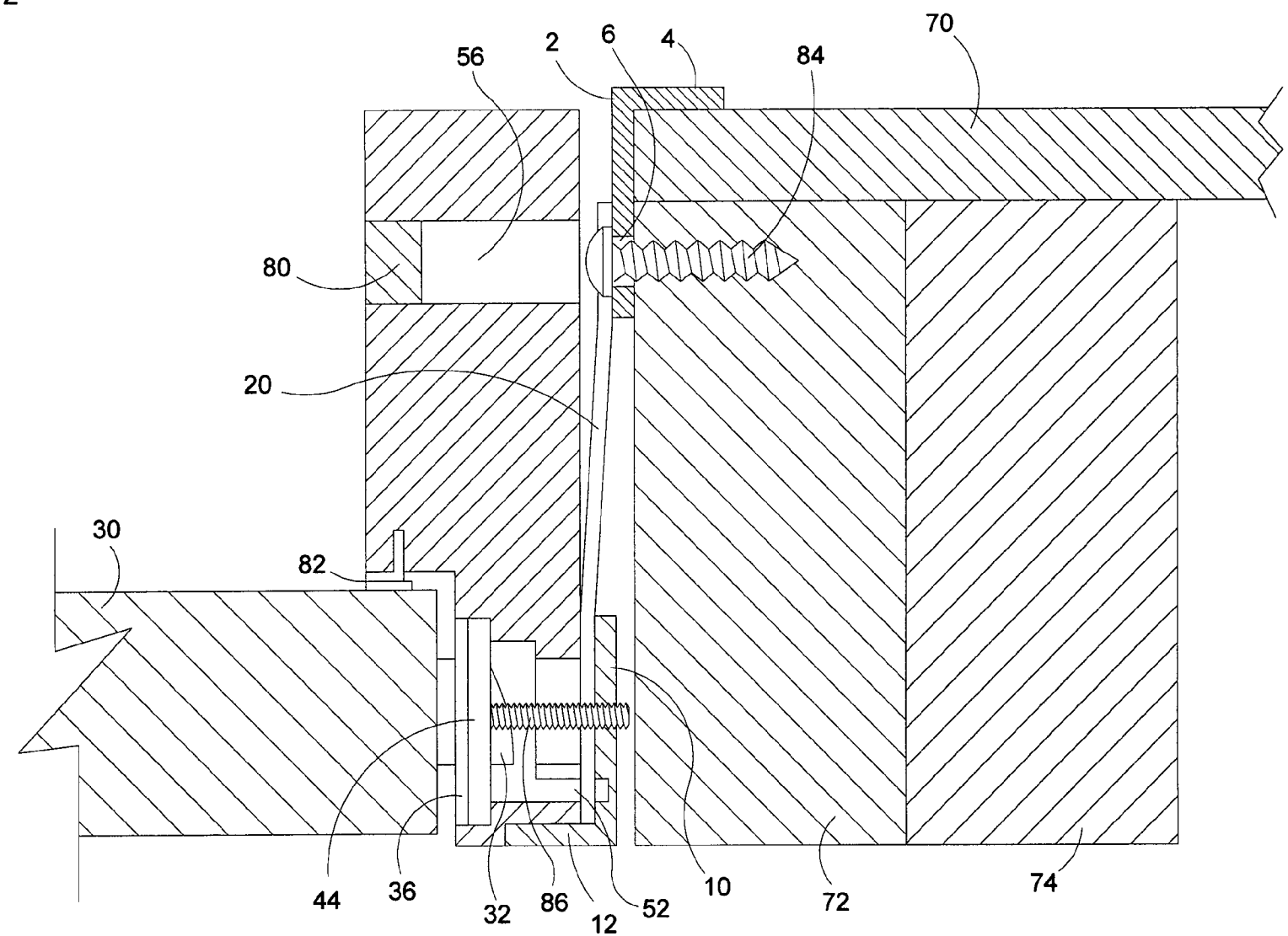
FIG. 2 is a partial sectional and assembled or non-exploded view as indicated in FIG. 1.

Referring further to FIGS. 1 and 2, a door jamb engaging "L" beam preferably consisting of a web 10 and a laterally inwardly extending hook or foot 12, is preferably provided. Preferably, the hook or foot 12 is nestingly received within a fitted mortise 68 within the longitudinally inwardly facing surface of door jamb 54. Such mortise fitting allows interior trim (not depicted) lining the interior of the doorway to completely conceal the assembly 1. Similarly, with the longitudinally opposed door buck engaging "L" beam, the foot 12 of the jamb engaging "L" beam may suitably, though less desirably, be omitted, the requisite hooking element alternately comprising machine threaded screws 86 which extend through apertures 38, 42, 46, 50, 64, and 66 for threaded engagement with threaded apertures 14 and 18.

Figure 3:
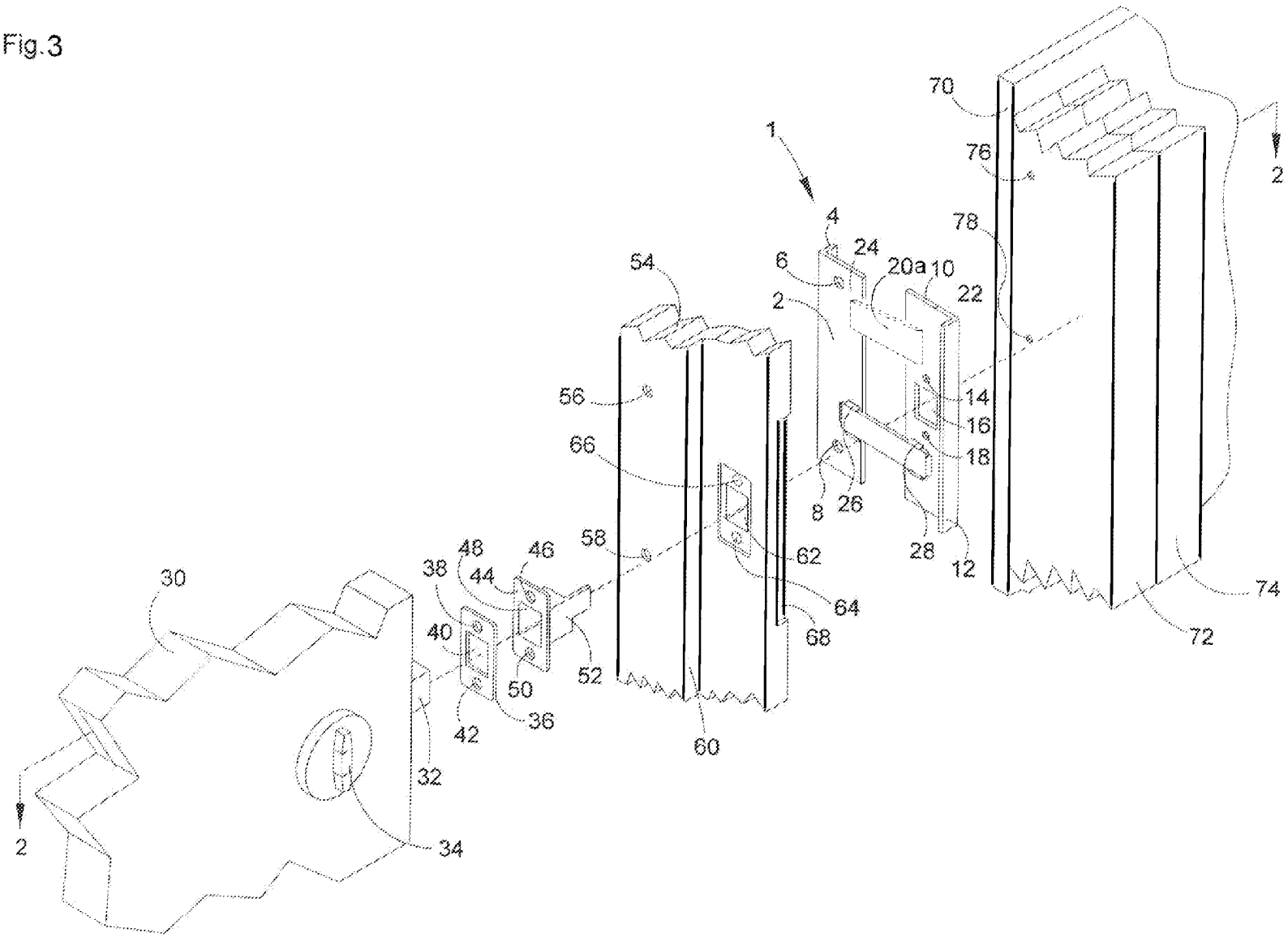
FIG. 3 redepicts FIG. 1, FIG. 3 alternately including a representational structure shown a dashed line box.

Referring to FIG. 1, laterally flexible steel bands 20 preferably span between and longitudinally interconnect webs or plates 2 and 10, such bands preferably being affixed by welds 22, 24, 26, and 28. Referring further simultaneously to FIG. 3, the representational dashed line box structure which is identified by Reference Numeral 20*a* designates suitable alternately used "straps, cables, cords, chains, or hinged plates.

Referring simultaneously to FIGS. 1 and 2, a strike plate 44 having a central bolt receiving aperture 48, and having upper and lower mounting screw apertures 46 and 50, is preferably formed wholly with or has fixedly attached thereto a bolt extension plate 52. Such plate preferably extends laterally outwardly from the laterally outward surface of strike plate 44.

In assembly of the instant invention, the strike plate 44 is extended laterally toward jamb 54, causing bolt extension plate 52 to pass laterally through a mortised bolt and bolt extension plate receiving aperture 62 within jamb 54, and causing the strike plate 44 to nest within the fitted mortise. Substantially simultaneously, the "L" beam and flexible band assembly 1 is placed over the lateral outer surface of jamb 54 and is aligned so that aperture 16 aligns with aperture 62, and so that threaded apertures 14 and 18 align with jamb apertures 66 and 68. Also substantially simultaneously, a matching trim piece 36 is placed over the lateral inner face of strike plate 44 so that apertures 38, 40, and 42 respectively align with apertures 46, 48, and 50. Thereafter, helically threaded machine screws 86 are extended laterally outwardly through apertures 38, 46, and 66, and through apertures 42, 50, and 68 to threadedly extend into and mount within matchingly threaded apertures 14 and 18, such screw extensions securely mounting the assembly 1 upon the outer lateral face of jamb 54. Thereafter, a pair of pilot holes (not depicted) are preferably drilled laterally inwardly through jamb 54, such pilot holes being laterally aligned with apertures 6 and 8 within "L" beam web 2. Thereafter, larger screw passage apertures 56 and 58 are preferably oppositely drilled along such pilot holes.

Referring further simultaneously to FIGS. 1 and 2, a door casing (not completely depicted) including door jamb 54, along with a door 30 which is hingedly mounted within such casing, is preferably framed and mounted in conventional fashion within a doorway a portion of which is laterally defined by a structurally solid door buck 72 and 74. During such door mounting process, the door jamb 54 is typically laterally aligned by wedge shimming, which urges the jamb to a true or vertically plumb position. While such door jamb alignment movements occur, the assembly 1 advantageously travels laterally with jamb 54 without interfering with the jamb alignment.

Following such conventional door and casing installation as described above, wood screws 84 are laterally outwardly extended through screw passages 56 and 58, and are screw driven through apertures 6 and 8 within web 2 into door buck member 72, securely positioning web 2 and hooking foot 4 upon such door buck member. As the screws 84 are drawn tight, band 20 functionally flexes laterally outwardly without skewing the set positioning of the jamb 54.

Referring simultaneously to FIGS. 1 and 2, as a final step to installation of the instant inventive assembly 1, wooden plugs 80 may be inserted into screw passage channels 56 and 58, restoring a finished appearance to the door jamb 54.

In operation of the instant invention, referring simultaneously to FIGS. 1 and 2, thumb turn 34 may be turned counter-clockwise, withdrawing bolt 32 into door 30. Thereafter, door 30 may freely swing longitudinally inwardly. Upon closure of door 30, the door 30 may come to rest against a weather stripping liner 82 which preferably is mounted within a chamfered door stopping face 60 milled with jamb 54. Thereafter, thumb turn 34 may be turned clockwise to laterally outwardly extend bolt 32. As can be seen in FIG. 2, upon such extension the longitudinally inward face of bolt 32 overlaps the strike plate 44, while failing to extend sufficiently to enter aperture 16 within the jamb engaging "L" beam's web 10. The bolt extension plate 52 accommodates such insufficient lateral length of bolt 32 by rigidly bridging between the strike plate 44 and aperture 16, the bridge supporting bolt 32. As a result of such structural bridging, upon application of a kicking force to the exterior of door 32, the longitudinally inward face of bolt 32 drives against the longitudinal outward face of bolt extension plate 52. Substantially simultaneously, the longitudinally inward face of bolt extension plate 52 drives against a longitudinally outwardly oriented face of aperture 16, transferring such force to web 10, thence to bands 20, and finally to the door buck engaging "L" hook. In the event that the kicking force (or other striking force such as a sledge hammer blow), is applied to the longitudinally outer surface of jamb 54, such force is transferred directly to the hook 12 of the jamb engaging "L" beam, and thence via bands 20 to the opposing door buck engaging "L" beam.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A kick-in resistant door reinforcing assembly for reinforcing a door jamb comprising:

(a) a doorway hook having a laterally outwardly extending doorway engaging face, the doorway hook comprising a first web, the first web having a longitudinal inner edge;

(b) a jamb hook having a laterally inwardly extending jamb engaging face, the jamb hook comprising a second web, the second web having a longitudinally outer edge; and, (c) hook interconnecting means spanning between the first and second webs, the hook interconnecting means being laterally flexible and being adapted for permitting alternate laterally inward and outward movements of the doorway and jamb hooks with respect to each other during installation of the assembly, the hook interconnecting means comprising an inter-linking member selected from the group consisting of bands, straps, cables, cords, chains, and hinged plates, the hook interconnecting means positioning the doorway and jamb hooks so that the first web's longitudinally inner edge is displaced longitudinally outwardly from the second web's longitudinally outer edge.

2. The kick-in resistant door reinforcing assembly of claim 1 wherein the doorway hook comprises a doorway engaging "L" beam, said beam comprising the first web and a first foot.

3. The kick-in resistant door reinforcing assembly of claim 2 wherein the jamb hook comprises a jamb engaging "L" beam, said beam comprising the second web and a second foot.

4. The kick-in resistant door reinforcing assembly of claim 3 wherein the first web or the first foot has a fastener receiving slot or aperture therethrough.

5. The kick-in resistant door reinforcing assembly of claim 4 wherein the second web has a second fastener receiving slot or aperture extending therethrough.

6. The kick-in resistant door reinforcing assembly of claim 5 wherein the second web has a bolt extension plate receiving aperture therethrough.

7. The kick-in resistant door reinforcing assembly of claim 6 further comprising a bolt extension plate having a proximal end and having a distal end, the distal end extending laterally through the bolt extension plate receiving aperture.

8. The kick-in resistant door reinforcing assembly of claim 7 wherein the distal end of the bolt extension plate extends outwardly, and further comprising a bolt receiving strike plate, the proximal end of the bolt extension plate being fixedly attached to or formed wholly with the bolt receiving strike plate.

9. The kick-in resistant door reinforcing assembly of claim 5 further comprising and at least a first screw, the at least first screw extending through the second web's second fastener receiving slot or aperture and fixedly attaching the jamb engaging "L" beam to the door jamb.

10. The kick-in resistant door reinforcing assembly of claim 9 wherein the second web has a first bolt extension plate receiving aperture therethrough, and wherein the door jamb has a second bolt extension plate receiving aperture therethrough, the first bolt extension plate receiving aperture being aligned laterally with the second bolt extension plate receiving aperture.

11. The kick-in resistant door reinforcing assembly of claim 10 further comprising a bolt extension plate having a proximal end and a distal end, the distal end extending through the first and second bolt extension plate receiving apertures.

12. The kick-in resistant door reinforcing assembly of claim 11 wherein the distal end of the bolt extension plate extends outwardly, and further comprising a bolt receiving strike plate fixedly attached to the door jamb, the proximal end of the bolt extension plate being fixedly attached to or formed wholly with the bolt receiving strike plate.

13. The kick-in resistant door reinforcing assembly of claim 5 further comprising, a door buck positioned laterally outwardly from the door jamb, at least a first screw extending through the second web's second fastener receiving slot or aperture and fixedly attaching the jamb engaging "L" beam to the door jamb, and at least a second screw extending through the first web's or first foot's fastener receiving slot or aperture and fixedly attaching the doorway engaging "L" beam to the door buck.

14. The kick-in resistant door reinforcing assembly of claim 13 wherein the second web has a first bolt extension plate receiving aperture therethrough, and wherein the door jamb has a second bolt extension plate receiving aperture therethrough, the first bolt extension plate receiving aperture being aligned laterally with the second bolt extension plate receiving aperture.

15. The kick-in resistant door reinforcing assembly of claim 14 further comprising a bolt extension plate having a proximal end and a distal end, the distal end extending through the first and second bolt extension plate receiving apertures.

16. The kick-in resistant door reinforcing assembly of claim 15 wherein the distal end of the bolt extension plate extends outwardly, and further comprising a bolt receiving strike plate fixedly attached to the door jamb, the proximal end of the bolt extension plate being fixedly attached to or formed wholly with the bolt receiving strike plate.

* * * * *